US006502246B1

(12) United States Patent
Porter

(10) Patent No.: US 6,502,246 B1
(45) Date of Patent: Jan. 7, 2003

(54) ADJUSTABLE BALL CAP

(76) Inventor: Thomas L. Porter, 443 Richland Rd., Marion, OH (US) 43302

( * ) Notice: Subject to any disclaimer, the term of this patent is extended or adjusted under 35 U.S.C. 154(b) by 0 days.

(21) Appl. No.: 09/883,408

(22) Filed: Jun. 18, 2001

(51) Int. Cl.[7] ..... A42B 1/22

(52) U.S. Cl. ..... 2/195.3; 2/195.2; 2/195.1; 2/181; 2/175.1

(58) Field of Search ..... 2/195.3, 195.2, 2/910, 10, 417, 425, 60, 171.5, 171.6, 171.8, 182.1, 221, 235, 317, 237; 450/114

(56) References Cited

U.S. PATENT DOCUMENTS

| | | | | |
|---|---|---|---|---|
| 4,815,148 A | | 3/1989 | Satterfield | 2/197 |
| 5,615,415 A | | 4/1997 | Beckerman | 2/195.3 |
| 5,715,540 A | | 2/1998 | Cho | 2/195.3 |
| 5,966,742 A | | 10/1999 | Cunliffe | 2/195.3 |
| 6,016,572 A | * | 1/2000 | Park | 2/175.1 |
| 6,119,273 A | | 9/2000 | Cho | 2/195.3 |

* cited by examiner

*Primary Examiner*—John J. Calvert
*Assistant Examiner*—James G Smith
(74) *Attorney, Agent, or Firm*—David A. Greenlee

(57) ABSTRACT

A ball cap comprising a plurality of gores forming a body, a sweat band having an elastic sweat portion, and an elastic gore that is stretchable to provide a ball cap that is stretchable to assume a variety of stretched conditions to accommodate a variety of head sizes, comprising a stiffener assembly that continuously supports the elastic gore in all stretched conditions, said stiffener assembly comprising a main body portion sized to underlie the elastic gore in its unstretched condition, a transverse channel housing the sweat band elastic portion, and a pair of folded side wings attached to the side edges of the elastic gore which unfold as the ball cap stretches to its stretched conditions to continuously support the elastic gore and the elastic sweat band portion.

5 Claims, 3 Drawing Sheets

46a
40c
46
40b
40a
34
26
40
42
42b
42a
42c
44
46b (UNSTRETCHED)
6
6
20
40c
32
46
38
5
5
40b
40
40a
26
36
38
42
42a
34
42b
44
42c
46
32
22
46b (STRETCHED)
46
34
36
44
40a
40b
26

32
46
20

ADJUSTABLE BALL CAP

BACKGROUND OF THE INVENTION

1. Technical Field

This invention relates to billed caps and, more particularly, to such a cap that is self-adjusting to fit all head sizes.

2. Background Art

Originally billed caps, commonly referred to as "ball caps", were produced in a variety of fixed sizes, which usually varied by ⅛ inch, to custom fit customers. This caused inventory and manufacturing problems, which resulted in uniformly high cap prices. Many attempts have been made to provide a "one-size-fits-all" ball cap, so that only one size of hat need be produced and inventoried. These include providing a cutout or gap in the cap rear and an adjustable-length strap that can be sized to various head sizes.

This type of hat has found great popularity and has effected an explosion in novelty hat sales, as prices have plunged as compared to the sized hats. These hats, of necessity, have an inherent defect in that they cannot compare in appearance to sized hats because of the rear gap, which causes a folding of material when sized for all but the largest head. In a word, they look "cheap". To overcome this, attempts have been made to provide a more fitted look. One includes a flap to cover this discontinuity in cap design, as shown in U.S. Pat. No. 4,815,148—Satterfield.

A more successful arrangement provides excessive material which is gathered by an elastic sweat band that stretches to fit all head sizes. This suffers from a bunching of material and looks "cheap". Several more recent patents, U.S. Pat. No. 5,615,415—Beckerman, U.S. Pat. No. 5,715,540—Cho, and U.S. Pat. No. 5,966742—Cunliffe, illustrate variations of a cap having stretchable rear gores and elastic sweat bands. These have found little commercial success because they are difficult to manufacture and do not provide the look of a fitted hat because the elastic gores have no "body".

A more recent design of cap, as shown in U.S. Pat. No. 6,016,572—Park, provides an elastic gusset between gores, which is expensive to manufacture and is limited in its ability to stretch.

Finally, an attempt to combine the cutout and strap with elastic gores, is shown in U.S. Pat. No. 6,119,273—Cho, which combines the worst features of elastic and strap, has severely limited stretchability and, again looks "cheap".

None of these attempts to provide a "one size fits all", or "free size" hat having the appearance of a fitted cap. Thus, there is a need for a ball cap that has the appearance of a fitted cap, but is capable of fitting many head sizes.

BRIEF SUMMARY OF THE INVENTION

It is, therefore, an object of this invention to provide a ball cap that has the appearance of a fitted cap, but is capable of fitting many head sizes.

This invention is directed to a ball cap that has an elastic gore and partially elasticized sweatband, both of which are supported by a unique system of stiffeners that completely support the elasticized portions to provide the appearance of a fitted cap when stretched to any size.

In one aspect, this invention features a ball cap having a front bill, a plurality of gores that meet at the cap crown, wherein one of the gores is elasticized to enable circumferential stretching of the cap to accommodate a plurality of different head sizes, and including a folded stiffener assembly underlying the stretchable gore which unfolds as the gore stretches to provide continuous support for the gore at any head size.

In another aspect this invention features a self-adjusting sweat band that includes a main non-stretchable segment underlying all gores except the stretchable gore, and stretchable segment underlying the stretchable gore, the stretchable segment being attached at its ends to the main portion, wherein the minor portion is sufficiently long to slide along the remainder of the sweatband to provide a substantially continuous non-stretchable sweatband around the circumference of the cap at all head sizes.

These and other objects and features of this invention will become more readily apparent upon reference to the following detailed description of a preferred embodiment, as illustrated in the accompanying drawings, in which:

DETAILED DESCRIPTION OF THE INVENTION

Figure 1:
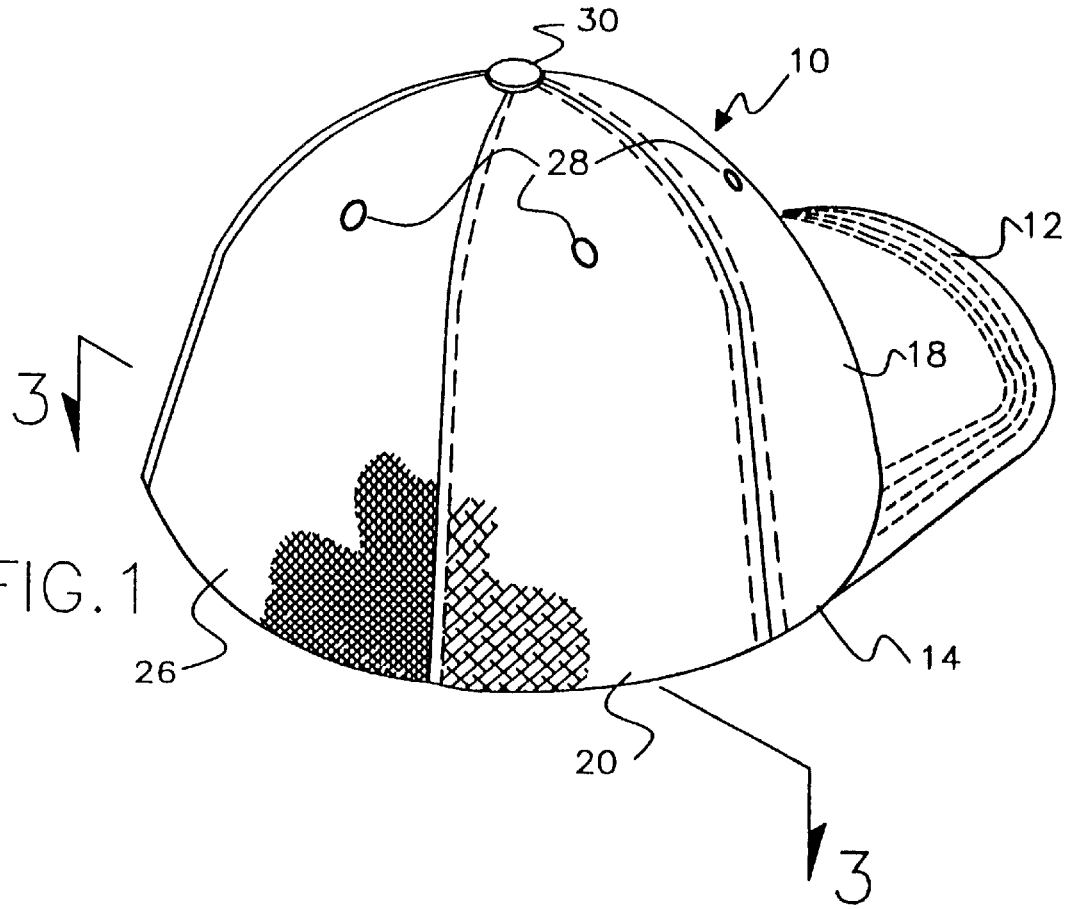
FIG. 1 is an external perspective view of the adjustable cap of this invention.
Figure 2:
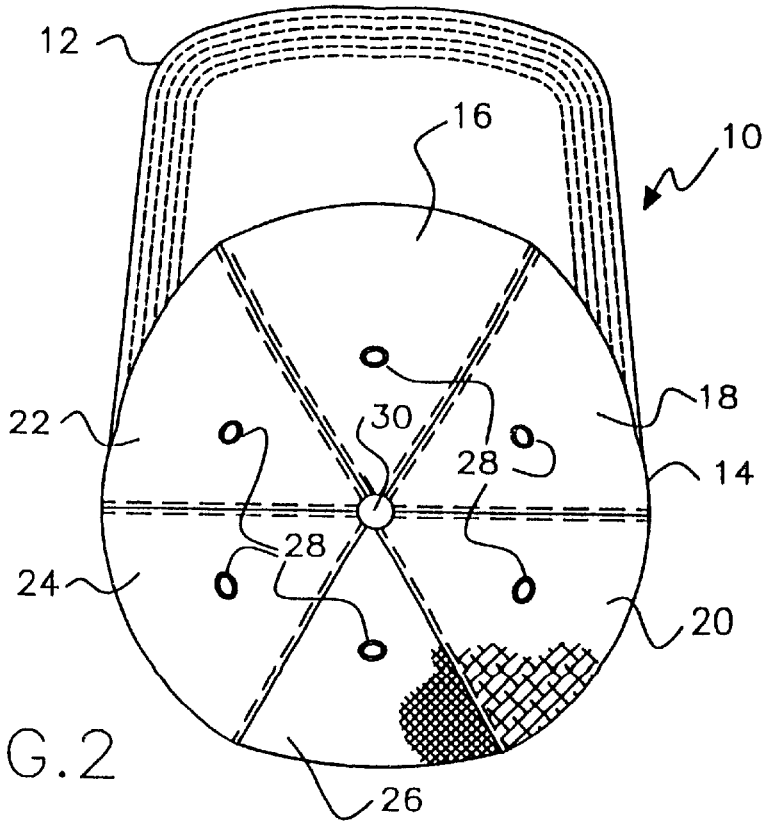
FIG. 2 is a top view of the cap of FIG. 1.

Referring now to FIGS. 1 and 2, a ball cap 10, comprises a bill 12 that is attached to the body 14 of cap 10 in the usual manner. Cap body 14 preferably comprises a front gore 16, side gores 18, 20, 22 and 24, and a rear gore 26. Each gore includes the usual vent hole 28 and all gores have a generally triangular shape extending from their bases to their apexes at a crown button 30.

Figure 7:
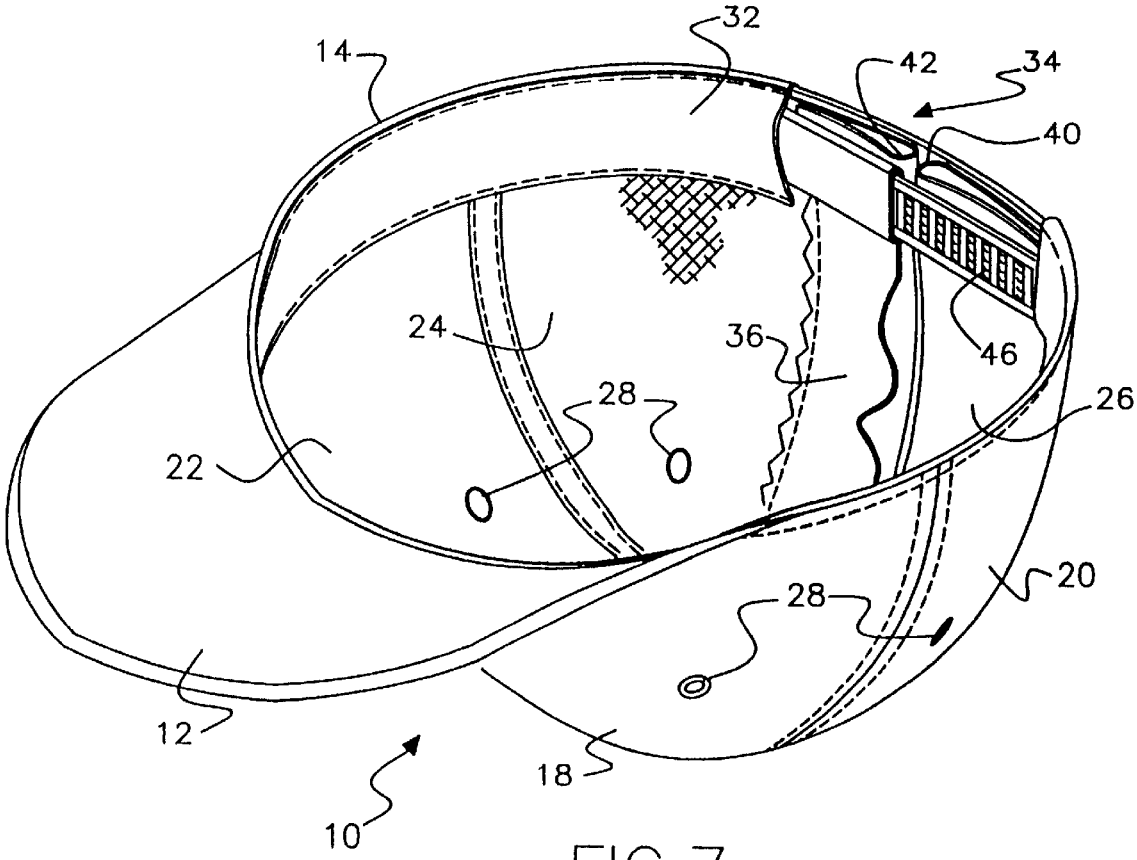
FIG. 7 is a perspective view of the cap interior.

Bill 12 is formed of a stiffener covered by the usual cap material, which can include wool, synthetic fibers or cotton twill. Gores 16, 18, 20, 22 and 24 are formed of a similar material which is preferably lightweight. At least the front gore 16 is sufficiently stiff or includes a stiffener to enable retention of the shape of the cap under most conditions, while remaining sufficiently flexible to the touch. The hat thus has what is commonly termed "body". All gores are preferably sewn together and cap 10 includes a sweatband 32 that is attached to the bottom of gores 16, 18, 20 22 and 24, as shown in FIG. 7. Sweatband 32 is bendable, yet stiff enough to enable hat 10 to retain its shape, and sufficiently water repellant to endure the usual perspiration emitted by a user's head.

Rear gore 26 is formed of a different material, one that is elastic at least in the circumferential direction, but may be elastic additionally in the vertical direction. Such a material is readily available from any manufacturer; the source is unimportant to this invention. Thus, rear gore 26 is stretchable and has little "body", which, of itself, does not match the shape of the other gores. However, gore 26 is the same color, or color scheme, as the other gores, to give the hat uniformity of appearance.

Figures 3, 4, 5, 6:
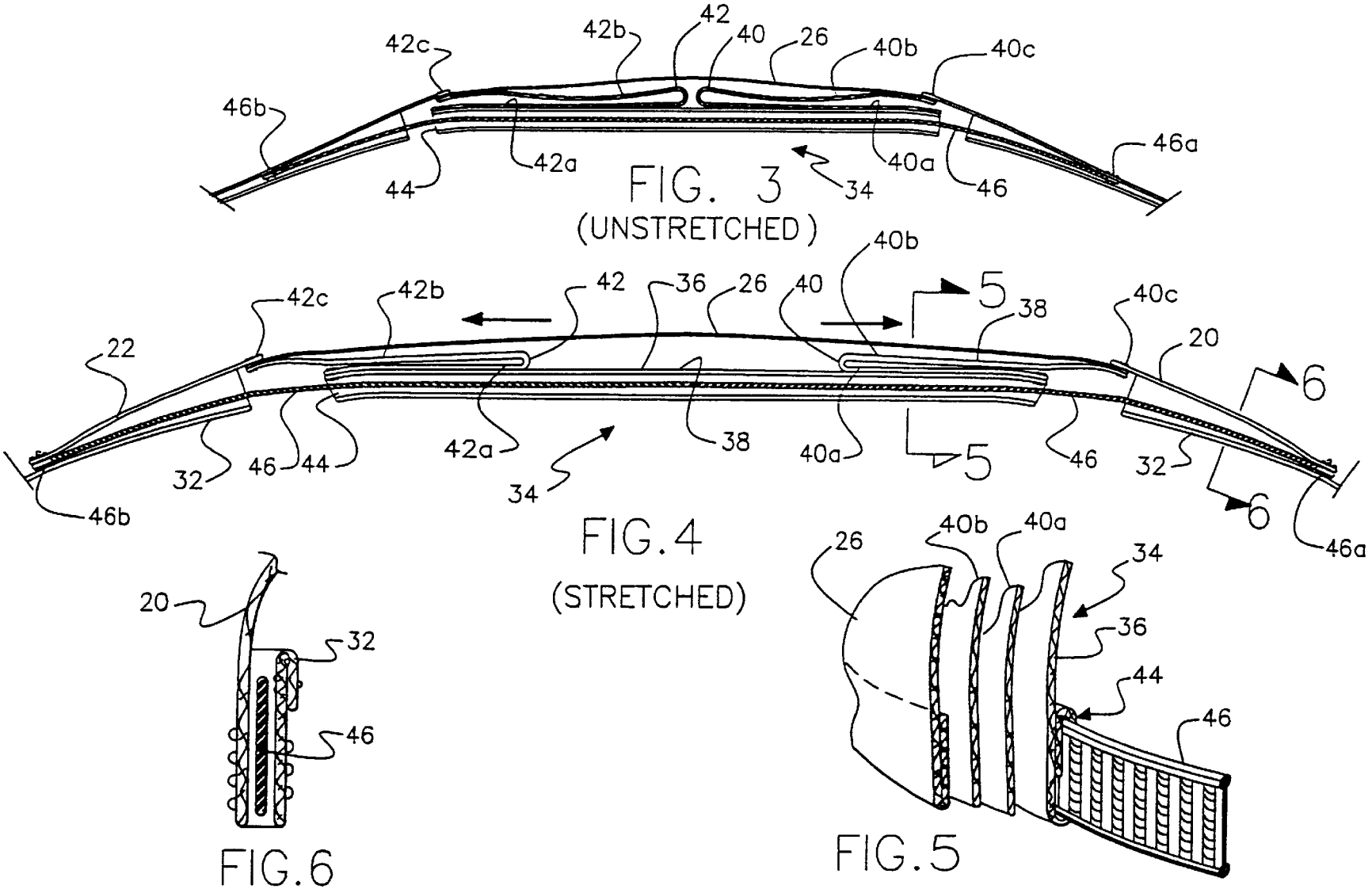
FIG. 3 is an enlarged sectional view taken along lines 3—3 of FIG. 1, showing the cap in unstretched condition.
FIG. 4 is a view similar to FIG. 3, but showing the cap in stretched condition.
FIG. 5 is a sectional view taken along the lines 5—5 of FIG. 4.
FIG. 6 is a sectional view taken along the lines 6—6 of FIG. 4.

To provide "body" to stretchable rear gore 26, this invention provides a stiffener assembly 34, which will now be described in reference to FIGS. 3–7. Stiffener assembly 34 comprises a pleated stiffener member 36, having a main portion 38 that is sized to match the size of gore 26 in its unstretched condition, as illustrated in FIGS. 1, 2 and 3. Stiffener member 36 includes folded wing portions 40 and 42 that have respective inner and outer portions 40*a*, 40*b* and 42*a*, 42*b*. Inner portions 40*a*, 42*a* are extensions of, or are sewn to the side edges of main portion 38. Outer portions 40*b*, 42*b* are extensions of inner portions 40*a*, 42*a*, and are sewn main portion 38. Outer portions 40*b*, 42*b* are extensions of inner portions 40*a*, 42*a*, and are sewn to the side edges of rear gore 26 and side edges of adjacent gores 20 and 22 at seams 40*c*, 42*c*.

Stiffener main portion 38 is folded over and sewn along its bottom edge to provide a transverse channel 44 that accommodates an elastic sweatband extension 46, that is sewn adjacent its ends to sweatband 32 at 46*a*, 46*b*. Sweat band portion 46, being elastic, has much less stiffness than sweat band 32.

Preferably, ball cap 10 is sized to a small head size, such as 6-½, in its unstretched condition. In this condition, FIG. 3, rear gore 26 is supported by the main body portion 38 and both folds of wings 40 and 42 of stiffener 36. Thus ball cap 10 has a uniform outward appearance, as shown in FIGS. 1, 2 and 3. When ball cap 10 is fitted on a larger size head, such as 7 or 7-½, elastic gore 26 stretches to accommodate the head, as shown in FIG. 4. In this stretched condition, gore 26 is supported by, not only the main stiffener portion 26, but also by wings 40 and 42. As can be seen, wings 40 and 42 smoothly unfold, or unroll, to continuously support elastic gore 26, no matter how far it is stretched. Also, sweatband extension 46 also stretches and moves through channel 44. In all positions of stretch, sweatband extension 46 is supported at its center by stiffener main body portion 38 and, beyond, by wing outer portions 40*b*, 42*b*. Thus, in any condition of stretch, stiffener 36 provides support for and "body" to elastic gore 26 and elastic sweats band extension 46.

Although only a preferred embodiment of this invention has been shown and described, many modifications are contemplated within the scope of the appended claims. For example, stiffener 36 may be formed of a single piece of material, or by several pieces sewn or otherwise bonded together. Also, sweatband extension 46 can be made of a non-elastic material with elastic strips attached to one or both ends.

I claim:

1. A ball cap comprising a plurality of gores forming a body, a sweat band, and an elastic gore that is stretchable to enable the ball cap to assume a variety of stretched conditions to accommodate a variety of head sizes, comprising a stiffener assembly that continuously supports the elastic gore in all stretched conditions.

2. The ball cap of claim 1, wherein the stiffener assembly includes a main body portion having at least one folded side wing attached to at least one edge of the elastic gore, thus enabling the at least one stiffener wing to unfold as the elastic gore stretches.

3. The ball cap of claim 2, wherein the stiffener assembly includes two side wings, each attached to one side edge of the elastic gore and to the side edge of an adjacent gore.

4. The ball cap of claim 2, where the sweat band comprises a non-stretchable main portion and a stretchable portion underlying the elastic gore, and the stiffener assembly includes a channel surrounding the stretchable portion through which the stretchable portion moves during stretching, the stiffener assembly also supporting the sweat band stretchable portion in all stretched conditions of the ball cap.

5. A ball cap comprising a plurality of gores forming a body, a sweat band having an elastic sweat portion, and an elastic gore that is stretchable to provide a ball cap that is stretchable to assume a variety of stretched conditions to accommodate a variety of head sizes, comprising a stiffener assembly that continuously supports the elastic gore in all stretched conditions, said stiffener assembly comprising a main body portion sized to underlie the elastic gore in its unstretched condition, a transverse channel housing the sweat band elastic portion, and a pair of folded side wings attached to the side edges of the elastic gore which unfold as the ball cap stretches to its stretched conditions to continuously support the elastic gore and the elastic sweat band portion.

* * * * *